US005973244A

United States Patent [19]

McCulloch

[11] Patent Number: 5,973,244

[45] Date of Patent: Oct. 26, 1999

[54] COLLAPSIBLE AND PORTABLE STAND FOR MUSICAL INSTRUMENTS

[76] Inventor: Mark W. McCulloch, 2215 McLean Ave., New Albany, Ind. 47150

[21] Appl. No.: 09/213,630

[22] Filed: Dec. 18, 1998

[51] Int. Cl.[6] ..... G10D 3/00

[52] U.S. Cl. ..... 84/327; 84/453; 248/121; 248/166; 248/434; D19/91

[58] Field of Search ..... 84/453, 421, 327, 84/280 R; D19/91; 248/121, 166, 434

[56] References Cited

U.S. PATENT DOCUMENTS

| | | | |
|---|---|---|---|
| D. 265,873 | 8/1982 | Smith | D6/85 |
| 1,773,237 | 8/1930 | Naujoks et al. | 248/121 |
| 2,153,821 | 4/1939 | Walberg | 248/121 |
| 2,490,356 | 12/1949 | Hummel | 45/57 |
| 2,522,345 | 9/1950 | Cashiopp | 248/121 |
| 3,376,009 | 4/1968 | Domino | 248/456 |
| 3,410,516 | 11/1968 | Criswell | 248/459 |
| 3,958,786 | 5/1976 | Mann | 248/176 |
| 4,321,874 | 3/1982 | Cenna, III | 108/99 |
| 4,691,610 | 9/1987 | Gilbert | 84/327 |
| 5,197,701 | 3/1993 | Olson | 248/166 |
| 5,350,143 | 9/1994 | Hoshino | 248/166 |
| 5,375,497 | 12/1994 | Pirchio et al. | 84/327 |
| 5,383,634 | 1/1995 | Liao | 248/166 |
| 5,497,689 | 3/1996 | Hoshino | 84/327 |
| 5,520,462 | 5/1996 | Clark | 383/37 |
| 5,664,756 | 9/1997 | Liao | 248/443 |
| 5,744,735 | 4/1998 | Liao | 84/327 |

FOREIGN PATENT DOCUMENTS

| | | |
|---|---|---|
| 2626101 | 7/1989 | France . |
| 189976 | 10/1963 | Sweden . |
| 2276314 | 9/1994 | United Kingdom . |

*Primary Examiner*—Robert E. Nappi
*Assistant Examiner*—Wesley Scott Ashton
*Attorney, Agent, or Firm*—Middleton & Reutlinger; James R. Higgins, Jr.

[57] ABSTRACT

A stand for a musical instrument, comprising first and second base members being hingedly connected to one another and being adjustable to move the stand base members between a closed position and an open position. Each base member includes an arm which is pivotably moveable between a retracted position, wherein the arm is flush with the base member, and an extended position, wherein the arm cooperates with an angled portion of each respective base member to support the musical instrument therein. A flexible strap connects lower ends of the base members to prevent the stand from opening beyond the open position thereof.

13 Claims, 5 Drawing Sheets

COLLAPSIBLE AND PORTABLE STAND FOR MUSICAL INSTRUMENTS

BACKGROUND OF THE INVENTION

1. Technical Field of the Invention

The present invention relates to stands for musical instruments, such as, for example, guitars, violins or the like. More particularly, the present invention relates to a stand for a musical instrument, such as, for example, a guitar, violin or the like, wherein the stand is foldable to permit easy transportation and storage thereof.

2. Description of the Related Art

Stands for musical instruments are known in the art and are typically provided to support a musical instrument, such as, for example, a guitar, violin or the like, in a substantially upright orientation. Musical instrument stands of the prior art are particularly useful, for example, when a musician plays the musical instrument several times during a single performance, but wherein the musician must otherwise temporarily set the instrument down, for example, to play another instrument or to take a break. Thus, it is desirable to provide a stand for a musical instrument, wherein the stand supports the instrument in a substantially upright orientation, and wherein the instrument may be quickly and easily removed therefrom and replaced therein.

However, many musical instrument stands typical of those of the prior art are bulky or otherwise difficult to transport and/or store. Thus, it is furthermore desirable to provide a stand for a musical instrument, wherein the stand is foldable to permit easy transportation and storage thereof.

SUMMARY OF THE INVENTION

The present invention is for a stand for musical instruments, such as, for example, guitars, violins or the like, wherein the stand supports a musical instrument in a substantially upright orientation, and wherein the stand is foldable to permit easy transportation and storage thereof.

It is an object of the present invention to provide a stand for a musical instrument, wherein the stand supports the instrument in a substantially upright orientation, and wherein the instrument may be quickly and easily removed therefrom and replaced therein.

It is another object of the present invention to provide a stand for a musical instrument, wherein the stand is foldable to permit easy transportation and storage thereof.

The present invention provides a convenient and decorative collapsible and portable stand for a musical instruments, such as a guitar or the like, to hold the instrument while it is not being played by the musician. Generally, the stand is made of two unitary shaped (such as triangular) base members which are hinged together at the respective apex of each triangular member. A flexible strap attached to the bottom of the triangular members, which folds between each unitary shaped member, limits the distance that the unitary members can be set apart, so that a stable unitary shaped base is formed from the two unitary members. Each unitary member is provided with a rotatable support arm each of which, in use, flips outwardly from the front edge of each unitary member. The bottom of a musical instrument, such as a guitar, rests on an upward edge of the outwardly rotated support arm, and the back of the musical instrument rests upon an outwardly projecting edge of each unitary member. The edges against which the musical instrument rests may be provided with non-stick portions so that the musical instrument will not slip from its at-rest position.

A stand for musical instruments according to a preferred embodiment of the present invention includes a first base member having an upper end and a lower end, a second base member having an upper end and a lower end, the upper end of the second member being hingedly connected to the upper end of the first base member and being adjustable to move the stand between a closed position and an open position, the first and second base members forming a first angle therebetween when the stand is in the closed position, the first and second base members forming a second angle therebetween when the stand is in the open position, the second angle being greater than the first angle; a first arm pivotably connected to a front portion of the first base member near the lower end thereof, the first arm being moveable between a retracted position and an extended position, and a second arm being pivotably connected to a front portion of the second base member near the lower end thereof, the second arm being moveable between a retracted position and an extended position.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENTS

Figure 1:
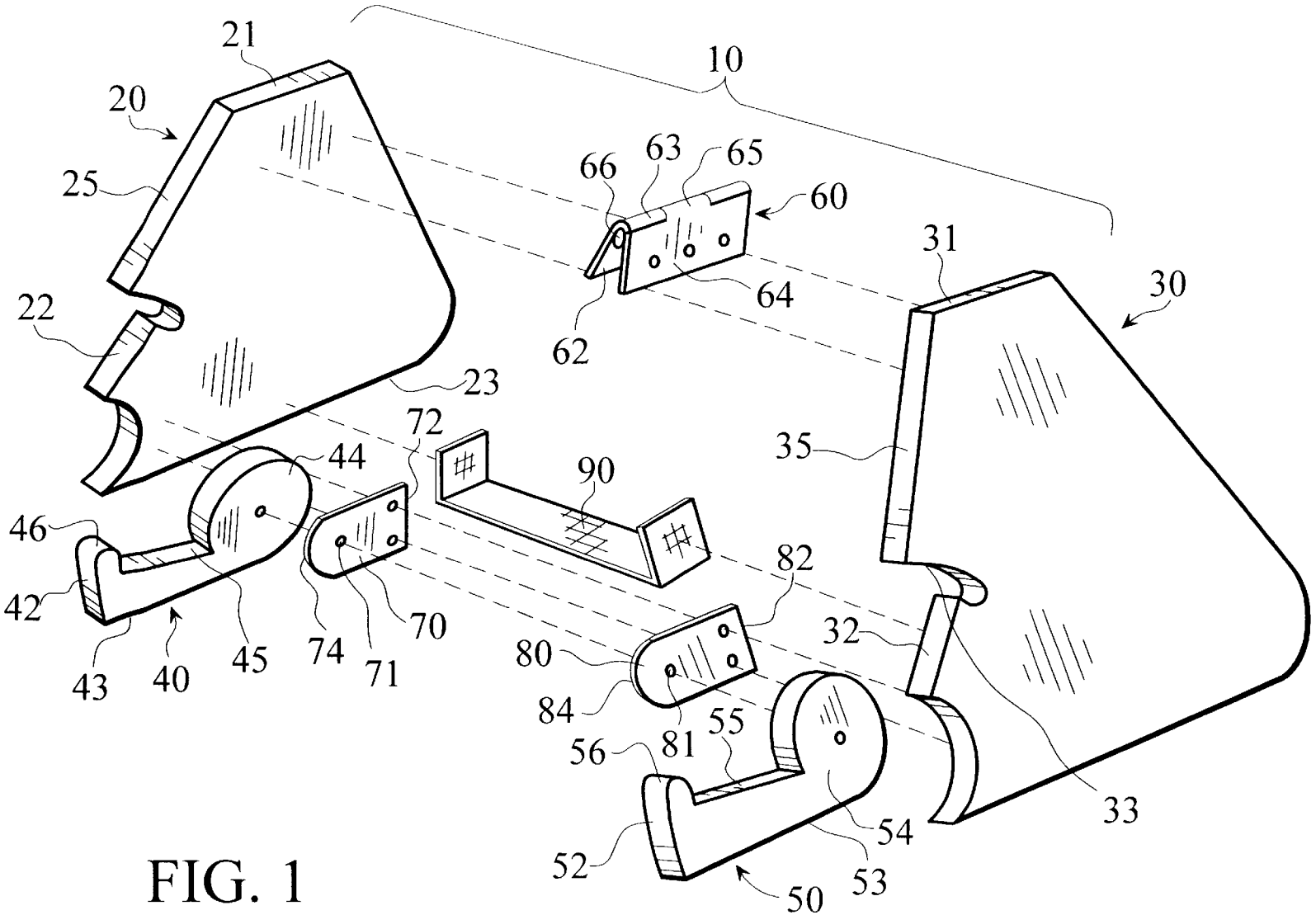
FIG. 1 is an exploded perspective view of a stand for a musical instrument according to a preferred embodiment of the present invention.
Figure 2:
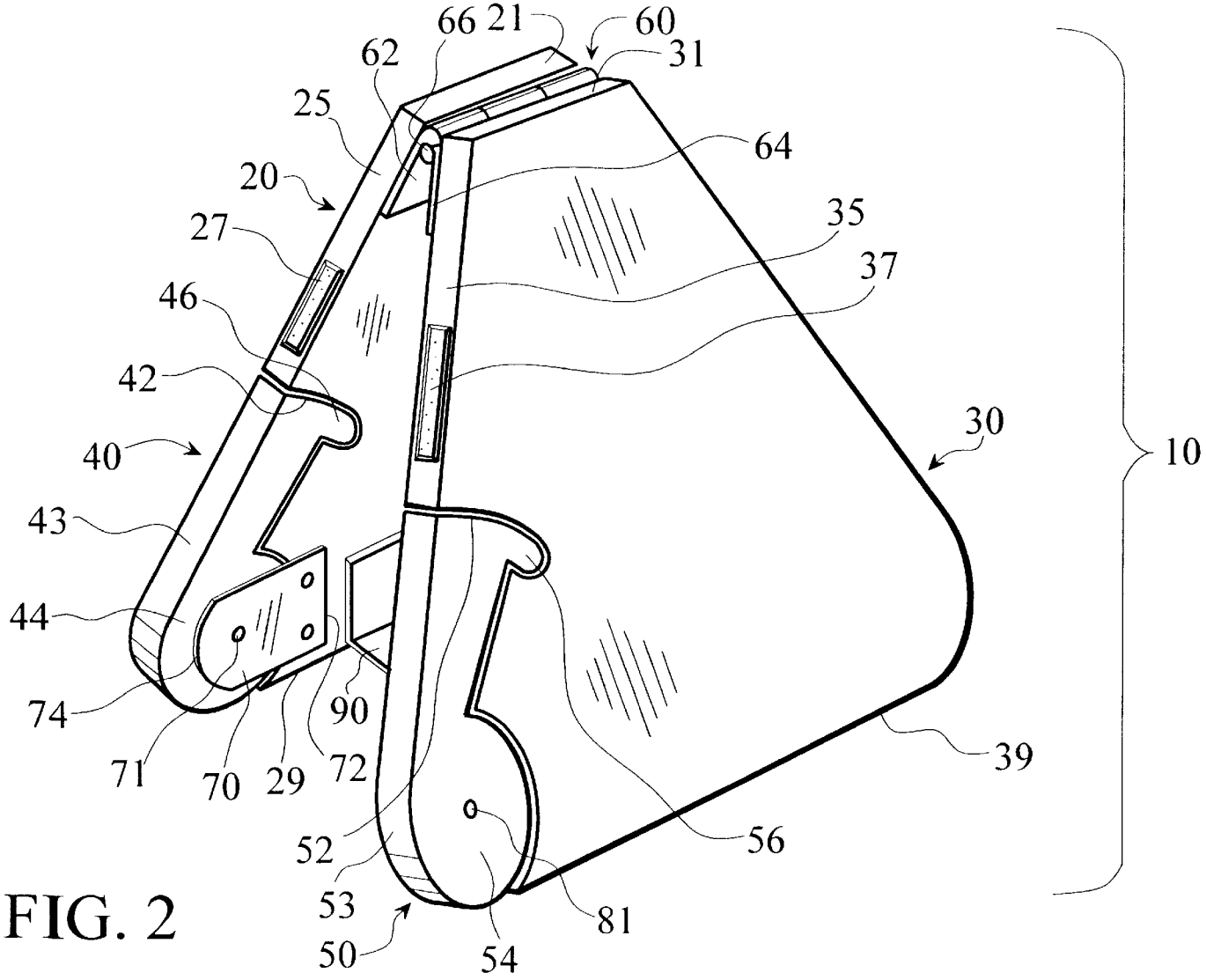
FIG. 2 is a perspective view of the stand of FIG. 1, shown in an open position, and shown with first and second arms in a retracted position.
Figure 7:
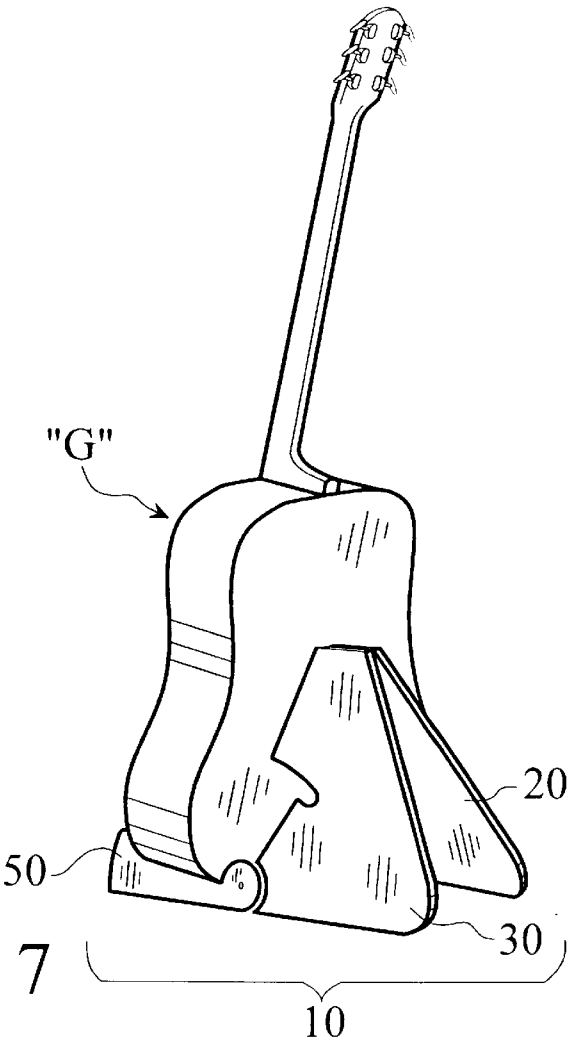

With reference to FIGS. 1 and 2, a stand 10 for a musical instrument "G" (FIG. 7), such as, for example, a guitar, violin or the like, includes a first base member 20 of unitary, for example triangular, configuration and a second base member 30 also of unitary, for example triangular, configuration, hingedly connected to the first base 20 by a continuous hinge 60. The first and second bases 20, 30, respectively, are preferably constructed from wood, but may alternatively be constructed from any sufficiently rigid material.

Figure 6:
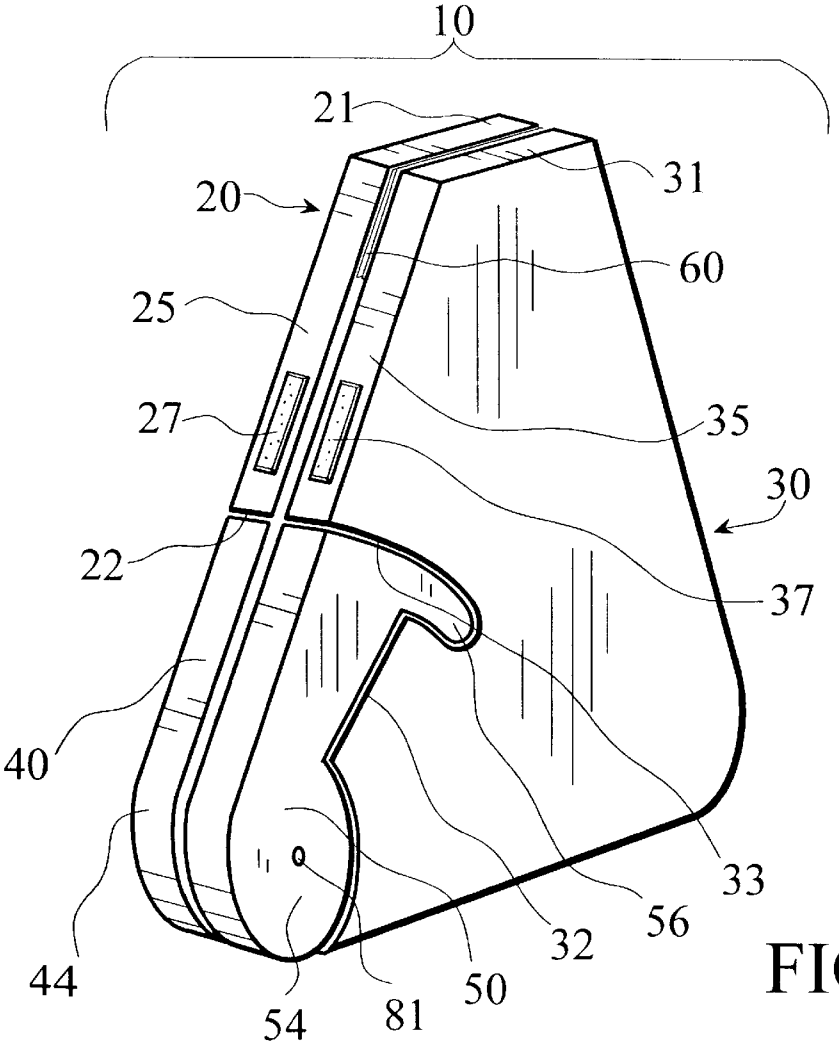
FIG. 6 is a perspective view of the stand of FIG. 1, shown in a closed position, and shown with first and second arms in a retracted position; and, FIG. 7 is a rear perspective view of the stand of FIG. 1, shown with a guitar being supported thereby.

The hinge 60 includes a first wing portion 62 secured to an upper end 21 of the first base member 20, for example, by one or more conventional screws (not shown), and a second wing portion 64 secured to an upper end 31 of the second base member 30, for example, by one or more conventional screws (not shown). The hinge first and second wing portions 62, 64, respectively, are connected to one another by a pin 66 passing through coaxial rounded portions 63, 65, respectively, which permits pivotable motion therebetween. For example, the first and second bases 20, 30, respectively, are pivotable about the hinge 60 between a stand closed position, such as is shown in FIG. 6, and a stand open position, such as is shown in FIG. 2. When the stand 10 is in the stand closed position (FIG. 6), first and second bases 20, 30, respectively, are substantially parallel, thereby permitting the stand 10 to be easily transported and stored. When the stand 10 is in the stand open position (FIG. 2), the stand 10 may be placed in an upright orientation, for example, on a floor, stage or platform, in which case, the stand 10 substantially resembles a stable pyramid.

A first support arm 40 is pivotably connected to the first base 20 such that the first arm 40 is pivotable in a first plane containing substantially the first base 20. A second support arm 50 is pivotably connected to the second base 30 such that the second arm 50 is pivotable in a second plane containing substantially the second base 30. The first and second planes intersect one another substantially along an axis of the hinge 60 when the stand 10 is in the stand open position. The first and second arms 40, 50, respectively, are preferably constructed from wood, but may alternatively be constructed from any sufficiently rigid material.

The first arm 40 is preferably connected to the first base 20 by a first plate hinge 70 having a back end 72 fixedly secured to the first base 20 near the lower end thereof, for example, by one or more conventional screws (not shown), and a front end 74 projecting forewardly from the first base 20. A proximal end 44 of the first arm 40 is pivotably connected to the front end 74 of the first plate hinge 70, for example, by a pin, bolt, screw or the like (not shown), which coincides with a first plate hinge pivot point 71. Support arm 40 is also provided with a base 43 which is contiguous with a bottom edge 29 of base member 20 when in an extended position. The first arm 40, then, is permitted to pivotably move between a retracted position, such as is shown in FIG. 2, and an extended position, such as is shown in FIG. 3.

The second arm 50 is preferably connected to the second base 30 by a second plate hinge 80 having a back end 82 fixedly secured to the second base 30 near the lower end thereof, for example, by one or more conventional screws (not shown), and a front end 84 projecting forewardly from the second base 30. A proximal end 54 of the second arm 50 is pivotably connected to the front end 84 of the second plate hinge 80, for example, by a pin, bolt, screw or the like (not shown), which coincides with a second plate hinge pivot point 81. Support arm 50 is also provided with a base 53 which is contiguous with a bottom edge 39 of base member 30 when in an extended position. The second arm 50, then, is permitted to pivotably move between a retracted position, such as is shown in FIG. 2, and an extended position, such as is shown in FIG. 3.

Figure 3:
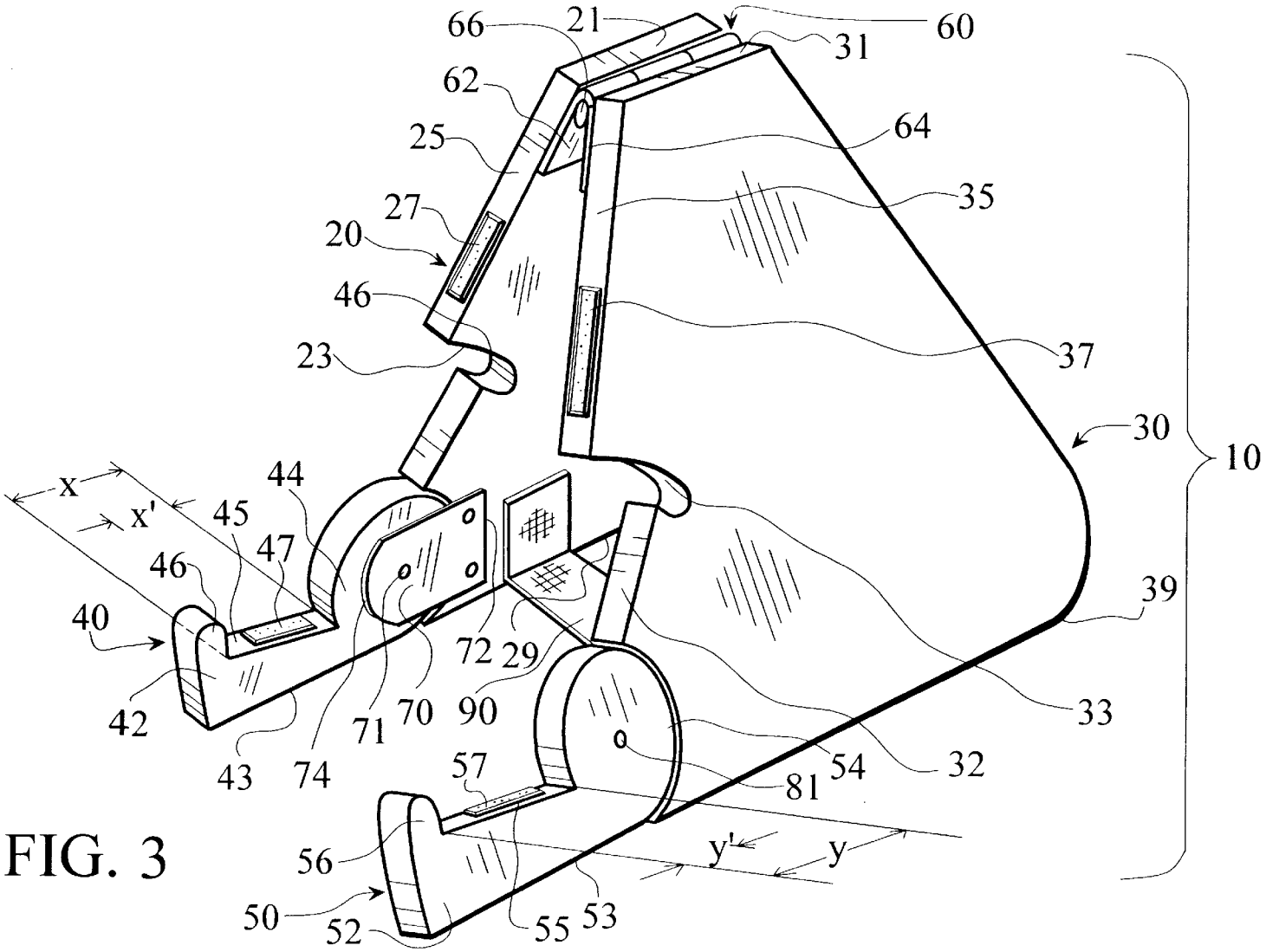
FIG. 3 is a perspective view of the stand of FIG. 1, shown in an open position, and shown with first and second arms in an extended position.

With additional reference to FIG. 3, each arm 40, 50 is pivotably moveable about its respective base 20, 30 to reach forewardly from the base 20, 30 and extend therefrom a preselected distance. More particularly, each arm 40, 50 includes an upturned portion 46, 56 at a distal end 42, 52, respectively, thereof which is spaced from its respective base 20, 30 to receive a musical instrument "G" (FIG. 7) therebetween. For example, where the stand 10 is intended to support an accoustic guitar thereby, the distance between the bases 20, 30 and their respective arm 40, 50 as denoted by the distances X and Y, must be greater than the distance X' and Y' when the stand 10 is intended to support an electric guitar, because an electric guitar is oftentimes much thinner than an accoustic guitar.

Each base 20, 30 includes an angled front edge 25, 35 which may have a strip of non-slip tape 27, 37 affixed along a portion thereof. An upper edge 45, 55 of each arm 40, 50 likewise may have a strip of non-slip tape 47, 57 affixed along a portion thereof. A musical instrument "G" (FIG. 7) supported by the stand 10, then, is cradled by the arms 40, 50 and the angled edges 25, 35 of the bases 20, 30, respectively, in an upright, back-angled orientation, and is further prevented from slipping therefrom due to the non-slip tape 27, 37, 47, 57.

The arms 40, 50 may be removable and re-attachable to permit exchanging thereof, where it is desired for the stand 10 to be able to support both acoustic guitars and electric guitars. For example, a first pair of arms may be provided which, when attached to their respective bases, would be spaced therefrom a sufficient distance to permit supporting an acoustic guitar thereby, and a second pair of arms may be provided which, when attached to their respective bases, would be spaced therefrom a sufficient distance to permit supporting an electric guitar thereby. The first and second pair of arms, then, would be removable from, and re-attachable to, their respective bases to permit the stand 10 to support both acoustic and electric guitars.

Figure 4:
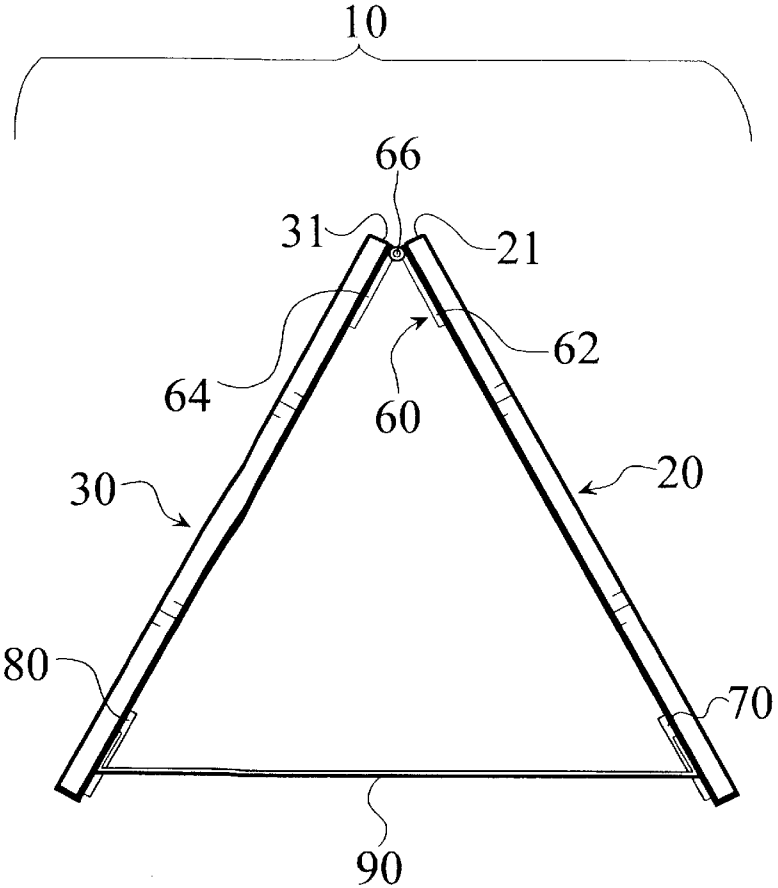
FIG. 4 is a rear view of the stand of FIG. 1, shown in an open position.

With additional reference to FIG. 4, a flexible strap 90 connects respective lower ends of the first and second bases 20, 30 and prevents the bases 20, 30 from opening beyond the stand open position. That is, when the stand 10 is in the stand closed position, the strap 90 folds along a center portion thereof upwardly between the first and second bases 20, 30, respectively. Opening the stand 10, then, for example, by pivoting the first and second bases 20, 30 about the hinge 60, unfolds the strap 90 until the strap is fully extended in an taut position, such as is shown in FIGS. 2–4, thereby preventing further opening of the stand 10. The strap 90 is preferably a flexible nylon strap material which is connected at its distal ends to interior surfaces of the first and second bases, respectively. The distal ends of the strap 90 may be affixed to the bases 20, 30 by any suitable means, including an adhesive, one or more rivets, or may alternatively be removably affixed thereto, for example, by snaps or by any conventional hook-and-loop type fastener.

Figure 5:
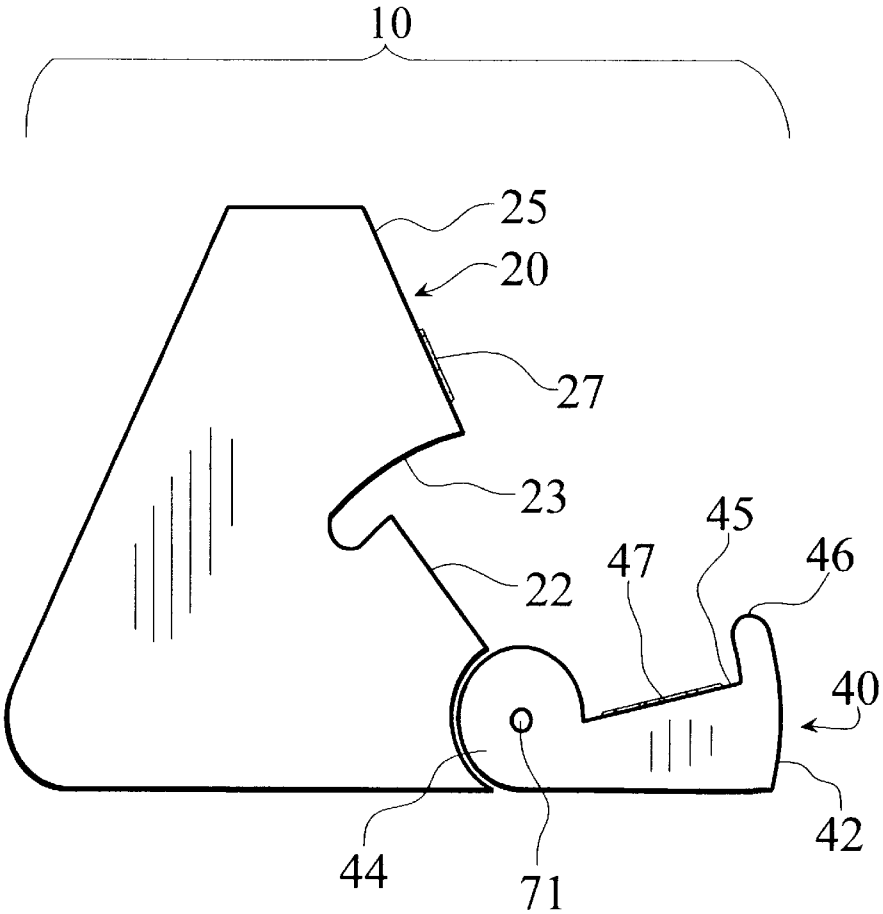
FIG. 5 is a side view of a first base of the stand of FIG. 1, shown with a first arm in an extended position.

With additional reference to FIG. 5, the first base 20 includes a cutout 22 having a shape which conforms substantially to the shape of the first arm 40. The distal end 42 of the first arm 40 includes a substantially arcuate outer face which conforms to an arcuate face 23 of the cutout 22 to permit the first arm 40 to be rotatably received by the cutout 22 about the first hinge 70 pivot point 71.

Similarly, the second base 30 includes a cutout 32 having a shape which conforms substantially to the shape of the second arm 50. The distal end 52 of the second arm 50 includes a substantially arcuate outer face which conforms to an arcuate face 33 of the cutout 32 to permit the second arm 50 to be rotatably received by the cutout 32 about the second hinge pivot point 81. Where the stand 10 includes one or more interchangeable arms 30, 40 to accommodate musical instruments of varying sizes as hereinabove described, each cutout 22, 32 must be sized and shaped to receive each of said varying arms 30, 40.

With additional reference to FIG. 6, the stand 10 is foldable into the stand closed position to permit easy transportation and storage thereof. More particularly, the first and second bases 20, 30 are pivoted about the hinge 60 towards one another so that opposing interior surfaces of the bases 20, 30 contact one another. As stated above, the flexible strap 90 folds upwardly between the first and second bases 20, 30 so that it does not extend from closed base. Each arm 40, 50 is received within its respective base cutout 42, 52, thereby forming a compact unit free of any protuberances.

Although the present invention has been described in terms of specific embodiments which are set forth in detail, it should be understood that this is by illustration only and that the present invention is not necessarily limited thereto. Accordingly, modifications are contemplated which can be made without departing from either the spirit or the scope of the present invention as described hereinabove.

I claim:

1. A collapsible portable stand for a musical instrument comprising:

two base members of unitary configuration, each having an upper end and a lower end;

said upper end of said base members being hingedly connected and movable between a closed position and an open position; and each of said base members having a support arm pivotally connected to a front portion of each of said base members near said lower end thereof, said support arms being movable between a retracted position and an extended position, said base members each having a cut-out along a front edge to receive said arms in said retracted position, and said support arms having a base contiguous with a bottom edge of said base members when said support arms are in said extended position.

2. The stand of claim 1 wherein said unitary configuration is triangular.

3. The stand of claim 2 including a flexible strap having opposite ends attached to said base members to limit the movement apart of said base members, whereby said base members are opened to a preselected position.

4. The stand of claim 2, wherein said flexible strap is in a substantially folded orientation when said stand is in said closed position, and wherein said flexible strap is in an elongated orientation when said stand is in said open position.

5. The stand of claim 4, wherein said flexible strap is folded substantially between said two base members when said stand is in said closed position.

6. The stand of claim 3, wherein said two base members are substantially parallel to each other when said stand is in said closed position.

7. The stand of claim 3, wherein each of said two base members includes a cutout for receiving said support arms therein when said support arms are in said retracted position, said support arms being substantially flush with each of said two base members when said support arms are in said retracted position.

8. The stand of claim 3, wherein each of said support arms includes an upturned portion thereof.

9. The stand of claim 3, wherein each of said two base members includes an angled portion to receive and provide support for a musical instrument.

10. The stand of claim 9, wherein said angled portion of each of said two bases includes a non-slip portion thereof on a front edge thereof.

11. The stand of claim 3, wherein each of said support arms includes a non-slip portion thereof.

12. The stand of claim 3, wherein one of said support arms is removably connected to one of said two base members and the other of said support arms is removably connected to the other of said two base members.

13. The stand of claim 3, wherein said flexible strap is removably connected to said two base members.

* * * * *